US009302745B2

(12) United States Patent
Wang

(10) Patent No.: US 9,302,745 B2
(45) Date of Patent: Apr. 5, 2016

(54) AIRCRAFT CARRIER REPLENISHMENT SYSTEM DESIGNED TO TRANSPORT CARGO USING CONTAINERS AND OIL TANKS

(71) Applicant: Wei Wang, Jiangxi (CN)

(72) Inventor: Wei Wang, Jiangxi (CN)

( * ) Notice: Subject to any disclaimer, the term of this patent is extended or adjusted under 35 U.S.C. 154(b) by 25 days.

(21) Appl. No.: 14/359,206

(22) PCT Filed: Nov. 7, 2012

(86) PCT No.: PCT/CN2012/084255
§ 371 (c)(1),
(2) Date: May 19, 2014

(87) PCT Pub. No.: WO2013/071832
PCT Pub. Date: May 23, 2013

(65) Prior Publication Data

US 2014/0321951 A1 Oct. 30, 2014

(30) Foreign Application Priority Data

Nov. 19, 2011 (CN) ..... 2011 1 0368794

(51) Int. Cl.
*B63B 25/00* (2006.01)
*B63B 27/10* (2006.01)
*B63B 27/00* (2006.01)
(Continued)

(52) U.S. Cl.
CPC ..... *B63B 27/30* (2013.01); *B63B 25/004* (2013.01); *B63B 27/10* (2013.01); *B63B 35/50* (2013.01)

(58) Field of Classification Search
CPC ..... B63B 27/10; B63B 27/12; B63B 25/004; B63B 19/08; B63B 27/16; B63B 27/30; B63B 27/36
USPC ..... 114/258, 259, 260, 261; 212/312; 414/137.9, 140.1, 141.5, 142.8, 142.9, 414/564
See application file for complete search history.

(56) References Cited

U.S. PATENT DOCUMENTS 2,363,797 A * 11/1944 Lovfald ..... B63B 25/002 114/72
2,541,893 A * 2/1951 Speer ..... B63B 27/10 114/375
(Continued)

FOREIGN PATENT DOCUMENTS

CN 201065285 5/2008
CN 101508328 8/2009
(Continued)

OTHER PUBLICATIONS

International Search Report for corresponding application PCT/CN2012/084255 file Nov. 7, 2012; Mail date Jan. 31, 2013.

*Primary Examiner* — Gregory Adams
(74) *Attorney, Agent, or Firm* — Cantor Colburn LLP

(57) ABSTRACT

An aircraft carrier replenishment system conveying goods using containers and oil tanks is disclosed. Two sides of the main body of each of an aircraft carrier and a replenishment ship are each provided with a loading window. The window at one side is a container loading window, and a container crane is provided in the window. The window at the other side is an oil loading window, and an operation room for connecting an oil delivery pipe is provided in the window. A marine crane for hoisting transport and oil travel between the aircraft and the replenishment ship. A network communication system is providing for connecting the aircraft carrier, the replenishment ship and the transport ships.

4 Claims, 5 Drawing Sheets

(51) Int. Cl.
*B63B 27/30* (2006.01)
*B63B 35/50* (2006.01)

(56) References Cited

U.S. PATENT DOCUMENTS 2,988,036 A * 6/1961 Mooneyhan ..... B63B 25/006 114/260
3,165,211 A * 1/1965 Ablett ..... B63B 27/00 114/85
3,207,329 A * 9/1965 Bevard ..... B63B 27/10 212/322
3,220,571 A * 11/1965 Kummerman ..... B63B 27/12 414/141.5
3,498,477 A * 3/1970 Sommer ..... B63B 27/12 114/201 R
3,528,527 A * 9/1970 Gregory ..... B66C 13/02 187/253
3,946,881 A * 3/1976 Ludvigsen ..... B66C 13/10 212/299
4,043,285 A * 8/1977 Nordstrom ..... B63B 25/004 114/72
4,552,082 A 11/1985 Grey
6,842,665 B2 * 1/2005 Karlen ..... B63B 25/22 108/51.11
7,815,031 B2 * 10/2010 Schneider ..... B63B 25/004 198/347.1

FOREIGN PATENT DOCUMENTS

GB 2087342 A * 5/1982 ..... B63B 27/16
JP 52001882 A * 1/1977
JP 55068493 A * 5/1980
JP 57057132 A * 4/1982
JP 58177827 A * 10/1983
KR WO 2011019121 A1 * 2/2011 ..... B63B 27/12
NO WO 2012008846 A1 * 1/2012 ..... B60L 11/18

* cited by examiner

AIRCRAFT CARRIER REPLENISHMENT SYSTEM DESIGNED TO TRANSPORT CARGO USING CONTAINERS AND OIL TANKS

TECHNICAL FIELD OF THE INVENTION

The invention is a systematic device that can move supplies and ammunition from a replenishment oiler to an aircraft carrier in this way of loading, unloading and transport.

BACKGROUND OF THE INVENTION

Exiting aircraft carrier has to stop fighting when it is replenished its supplies and ammunition of consumption. It has to connect with replenishment oiler to transport supplies and ammunition by mooring rope when it is in its state of voyage. If the fighting is still continuing, another aircraft carrier has to take the fighting and protect the aircraft carrier that is being replenished. Existing aircraft carriers are all replenished by this way and device.

SUMMARY OF THE INVENTION

To overcome the defect illustrated above, a kind of aircraft carrier replenishment system designed to transport cargo using containers and oil tanks. The systems have a loading and unloading port in the each sidewall of the replenishment oiler and aircraft carrier. In the course of replenishment, containers with supplies will be in turn moved to cabin of cargo carrier parking in the sea beside the loading and unloading port from the container loading and unloading port of the replenishment oiler. And then, the cargo carrier will transport the containers to the container loading and unloading port of the aircraft carrier to in turn lift up those containers into the container loading and unloading port; or to load and unload the oil for the cargo carrier with one to three oil tanks in the cabin on the side of the container loading and unloading port of the replenishment oiler and aircraft carrier; on the other side of the replenishment oiler and aircraft carrier is an oil loading and unloading port, specialized for the cargo carrier's cabin is a fixed oil tank for loading and unloading the oil; the loading and unloading of the oil is to connect the oil transport pipe in the loading and unloading port with the oil tank in the cargo carrier; on the two sides of the aircraft carrier and replenishment oiler, the loading and unloading port can load and unload the oil at the same time for the fixed oil tank of cargo carrier too; to transport the empty containers in the aircraft carrier back to the replenishment oiler is to in turn lift down the empty containers from the container loading and unloading port of the aircraft carrier to cabin in cargo carrier parking in the sea and then the cargo carrier will transport the empty containers to the side of the replenishment oiler and in turn move these empty containers to the container loading/unloading port of the replenishment oiler; only when the cargo carrier in the sea is fixed by the marine crane of the replenishment oiler and by the marine lifting unit of the aircraft carrier, the containers and oil are loaded and unloaded between the replenishment oiler and the cargo carrier, and between the cargo carrier and aircraft carrier. There are many cargo carriers between the replenishment oiler and the aircraft carrier to accomplish the transportation of the cargo and empty containers. One cargo carrier can stand 200 tons to 400 tons of solid cargo or oil at a time, and the cabin is a fixed oil tank cargo carrier used to load huge amount of aircraft fuel oil. The moving oil tank is respectively used to load less demanding oil species, or it can also load both the moving oil tank and container in one cargo carrier.

The above goal is to be reached in this way: First, loading and unloading ports 5 in sidewalls 4 of the aircraft carrier and in sidewalls 76 of the replenishment oiler, the ports on one side of the aircraft carrier and the replenishment oiler are the container loading and unloading ports 5, which are used to load and unload containers 24 and oils, and the ports on the other side of the aircraft carrier and the replenishment oiler are the oil loading and unloading ports 5 which is used to load and unload oils specially. Inside the container loading and unloading ports 5, there is a container crane used to load and unload containers which can move and arrive at the outside the container loading and unloading port 5 along a runway 3, and a first operator's cab 8 used to load and unload oils which hung to the container crane to the outside of the loading and unloading port 5, inside the container loading and unloading ports 5, there is a second operator's cab 75 hung on an outer side of a crane arm 77 which can move along a runway 78. Second, on each sides of the aircraft carrier, there is respectively a marine lifting unit, which is beneath the aircraft carrier's deck 1 above the outside of the loading/unloading port 5 of the aircraft carrier, the marine lifting units are used to hang and secure the cargo carrier 25 in the sea; on the left side and the right side of a gantry's column of a replenishment oiler's first gantry 86 and a second gantry 45, there is respectively a marine crane to hang and secure the cargo carrier 25 in the sea and to move the empty cargo carrier 25 from/to the sea to/from a first position 81 or a second position 84 on the replenishment oiler's deck. Three, there are four cargo carriers 25 shuttling between the aircraft carrier and the replenishment oiler to transport cargo, three of the four cargo carriers 25 have cabins 26 for fixed tank 71 which are dedicated to transporting oils. One of the four cargo carriers 25 includes cabin 26 which is suitable to carry three oil tanks 48 or carry 2 or 3 layers of the containers 24 placed up and down, the containers of each layer are arranged in three rows from left to right and in three lines from front to back. Forth, there is a control cab 35 in front of the marine lifting unit, and a control cab 35 in front of the gantry 74 on the marine crane; the control cab 35 can be used to lift the cargo carrier 25 using the marine lifting units or the marine cranes. Fifth, for facilitation of the operators' talking, data transmission, video monitoring and control right transfer, the loading and unloading ports 5, the first operator's cab 8, the second operator's cab 75, the control cab 35 of the aircraft carrier and the replenishment oiler and driving cab 38 are equipped with network communication devices.

The container crane comprises a crane arm 2, a trolley 9 and a sling 10, the crane arm 2 can move along a runway 3 from the inside the loading/unloading port 5 to the outside the loading/unloading port 5 to arrive over the cargo carrier 25 lifted by the marine lifting units and the marine cranes, the trolley 9 which lifts a container runs on the crane arm 2, the trolley 9 lifts the sling 10 by four fourth wire ropes 11 which are driven by windlasses, there are two downward guides 30 inside the trolley 9, and there is a runway 39 on each of the two guides 30, at top of the slings 10, there are two slide blocks 28 which are embedded in the two runways 39 respectively, the slings 10 run along the runway 39 up and down; when containers 24 are lifted from slide board 6 on the loading/unloading position A and from cargo carrier 25 on the loading/unloading position B lifted by the marine lifting units or the marine cranes, the trolley 9 runs on the crane arm 2 to the loading/unloading position A or the loading/unloading position B, after it, the slings 10 move guided by the guide 30 at the loading/unloading position A or the loading/unloading position B1 B2 B3 to fit a spin lock 29 into a lock hole 23 in the container 24 precisely. When the spin lock 29 fits into the lock hole 23, the slings 10 will lift up the containers 24. the container crane carries the container 24 and transports the container 24 between the slide board 6 on the loading/unloading position A inside the loading/unloading port 5 and the cabin 26 of cargo carrier 25 secured to the loading/unloading position B. Inside the loading/unloading port 5, a plurality of carrying boards can slide forward and backward to move the containers 24 from the loading/unloading position A to a cabin of the aircraft carrier and replenishment oiler, or to move the containers 24 from a cabin of the aircraft carrier and replenishment oiler to the loading/unloading position A.

The first operator's cab 8 and the second operator's cab 75 can approach a side of the cargo carrier 25 lifted by the marine lifting units or the marine cranes and connect an oil pipe 7 in the loading/unloading port 5 of the aircraft carrier and the replenishment oiler to the oil tank 48 or to the oil tank 71 of the cargo carrier 25 to load/unload oils.

Each marine lifting unit or marine crane has four hydraulic arms, there is a hook 21 at the lowest end of the each hydraulic arms. a marine lifting unit has two slide frames 36 and two runways 18, the slide frame 36 is driven inward/outward along the runway 18, there are two hydraulic arms beneath the slide frame 36 which is in front, there are two hydraulic arms beneath the latter slide frame 36, the distance between the two hydraulic arms's hooks 21 beneath the same slide frame 36 and the distance between the two rings 22 in the right and left at the cargo carrier 25 are equal. The distances between the two hooks 21 of the hydraulic arms on the front and rear slide frame 36 is equal to the distance between the two rings 22 front and rear at the cargo carrier 25; The four hooks 21 are used to catch four rings 22 on the cabin 26's four corners of cargo carrier 25 and hung and secured the cargo carrier 25.

Each of marine crane's four hydraulic arms is provided under each of the four corners of the gantry 74, the four hydraulic arms form a rectangle the distances between four hooks 21 at ends of the four hydraulic arms are equal to the distances between four lift rings 22 at four corners of the cabin 26.

Each of the four hydraulic arms has two hydraulic cylinders, cylinder 15 and cylinder 17, the hydraulic cylinder 17 is in the back, its upper end is connected with the joint axle 12 under the slide frame 36 and gantry 74, its bottom is a square plate 20, it connects the hooks 21 by a cardan joint 41 under the square plate 20, the mouth of the hooks 21 is backward; the hydraulic cylinder 15 is in the front, its upper end is connected with the joint axle 16 under the slide frame 36 and the gantry 74, its lower end is connected with the joint axle 14 at the front of the hydraulic cylinder 17; the end of two hydraulic cylinder 17 at the same line is connected and fixed by stick 13. The hydraulic cylinder 17 and the hydraulic cylinder 15 work together to move the hook 21 forward, backward, upward and downward to hook rings 22 and rise and fall the cargo carrier 25. There is a lock bar 42 at the mouth of the each hook 21, the lock bar 42 driven by a hydraulic cylinder 37 can lock the ring 22 be hanging hook 21.

Around the square plate 20, there are four tension springs 40 which connect the hook 21 at one end, the tension springs 40 are used to absorb horizontal and vertical impacts on the hook 21 during lifting of the ring 22; there are a first compression spring 88 and a second compression spring 89 between the square plate 20 and the cardan joint 41 to absorb vertical impacts on the hook 21 produced by the ring 22.

Each marine crane also comprises a gantry frame arm 61, a frame 62, a slide frame 63, a gantry 74, a first windlass 58, a second windlass 59, a first wire rope 56, a second wire rope 57, a third wire rope 60, a first pulley 55, a second pulley 65, a third pulley 49, a fourth pulley 68, a fifth pulley 69 and a sixth pulley 72.

In the each of the four gantry's columns of the replenishment oiler's first gantry 86 and second gantry 45, there is a first windlass 58, two first windlasses 58 on the same side are fixed on the same shaft, driven by the same motor; the gantry frame arm 61 of marine cranes sway around the shaft of the second windlass 59 between the highest and lowest position as a supine position make by the self gravity of the marine cranes on both sides of the replenishment oiler and the first windlass 58's pulling the second wire rope 57 which round the third pulley 49. In one gantry frame arm 61, there have two second windlasses 59 in tandem and is fixed on the same shaft, driven by the same motor two first wire ropes 56 front and rear winds around the first pulley 55 and the second windlass 59 plural times and connects to one point on the second windlass 59 and then connects to the inner end and the outer end of the slide frame 63 respectively to form a closed cycle. The slide frame 63's two front and rear frame bars are in front and rear frame bars' medial grooves of the gantry frame arm 61, the slide frame 63 is pulled by the first wire rope 56 and driven by the second windlass 59, and the slide frame 63 driven by the first wire rope 56 can slide in a front bar and a rear frame bar of the gantry frame arm 61. The line between the fourth pulley 68 and the second pulley 65 and the line between the first pulley 55 and the second windlass 59 are parallel. The frame 62 and the slide frame 63 are tied together by a shaft 70 into a cross shape movable connection, the front and rear two third wire ropes 60 round the second windlass 59 several times in the same way and the end is fixed on the second windlass 59. Starting from the second windlass 59, the another end of the third wire rope 60 winds around the second pulley 65, the fourth pulley 68, the fifth pulley 69, and the sixth pulley 72, returns back and winds around the fifth pulley 69, then are fixed to a shaft of the fourth pulley 68, the third wire rope 60 ties two ends of the shaft of the sixth pulley 72 so to reduce bending moment on the frame 62 which produced by the weight of cargo loaded on gantry 74. The fifth pulley 69 is the double pulleys. The third wire rope 60 is driven by the second windlass 59 and can stretch in equal length with the first wire rope 56. The second windlass 59 drags the first wire rope 56 when rotating in one direction, driving slide frame 63 and frame 62 slide inward, making the third wire rope 60 and the first wire rope 56 stretch synchronously; the second windlass 59 drags the first wire rope 56 when rotating in adverse direction, the first wire rope 56 slides outward around the first pulley 55 with slide frame 63 and frame 62. Frame 62 pulls the third wire rope 60 and the first wire rope 56 to stretch synchronously. The inside and outside bar of frame 62 are respectively the fourth pulley 68 and the sixth pulley 72's shafts. The outside bar of slide frame 63 is the fifth pulley's shaft. Gantry 74's central axis in front and rear direction is fastened into movable connection by outside aciform frame bar of frame 62. Gantry 74 can swing around the shaft of the sixth pulley 72. There is a brake 64 between the gantry 74 and the frame 62 to prevent the gantry 74's continue swinging motions relative to the frame 62, the brake 64 rotates around the shaft of the sixth pulley 72, and its braking disc is fixed on the gantry 74, and its braking caliper is fixed on the frame 62. 73 is the suspender between the gantry 74 and the control cab 35.

There is respectively a standing ring 22 at four corners of the cabin 26 of cargo carrier 25, at the bottom of the cabin 26, there are two second carrying boards 27 for moving the containers 24 from the loading/unloading position B at the central part of the cabin 26 to the front part or the rear part of the cabin 26.

The third operator's cab 35 in the aircraft carrier is lifted by the crane 34 to slide toward outside on the runway 33 and get into the window 32. There is respectively one ship carrying board 67 on each of the two sides of the replenishment oiler's deck, the ship carrying boards 67 can transport the cargo carrier 25 between the first position 81, the second position 84, a third position 83, and a fourth position 80.

There is a shelf 44 used to store movable tanks 48 between the second gantry 45 and third gantry 82, and between the fourth position 80 and the third position 83, and above the shelf 44, there is a crane 53 which is movable rightward and leftward between the second gantry 45 and the third gantry 82, there is a trolley 54 on the crane 53, which can move forward and backward, the trolley 54 carries two windlasses driven fifth wire ropes 51 which can lift and lower a sling 52, and the sling 52 has two hooks 50 at the end to carry the rack 47 of the movable tank 48, the crane 53 is used to move the empty movable tanks 48 from the shelf 44 into the cabin 26 of the cargo carrier 25 at the fourth position 80 or transport the empty movable tanks 48 from the cabin 26 of the cargo carrier 25 at the fourth position 80 to the shelf 44.

When it is not replenishing, the empty cargo carrier 25 is put on the first position 81, the second position 84, the third position 83, and the fourth position 80 of the deck on replenishment oiler. When replenishing, the marine crane on the two sides sling respectively cargo carrier 25 on the first position 81 and the second position 84 to the in sea and moves to the loading/unloading position B, but the hook 21 does not be separated with the ring 22 on cargo carrier 25. The crane arm 2 in the container loading/unloading ports 5 reaches outward to the upper side of the cargo carrier 25, trolley 9 and sling 10 on the first carrying board 6 of the loading/unloading position A hang the containers 24 loading cargo or ammunition one by one, move to the cabin 26 of the cargo carrier 25 on the loading/unloading position B and then put them in turn, or operations cab 8 hangs on the trolley 9 and move to the side of cargo carrier 25, the operator in operations cab 8 connects replenishment oil pipe 7 with the movable oil tank 48 or fixed oil tank 71 to load/unload oil; the crane arm 77 in the oil loading/unloading port 5 slides on the runway 78 to make the operations cab 75 reach out to the side of the cargo carrier 25, the operator in the operations cab 75 connects replenishment oil pipe 7 to the fixed oil tank 71 for loading/unloading oil. After finishing unloading the cargo to the cargo carrier 25, the crane arm 2 and the crane arm 77 stretch back to the loading/unloading port 5, the marine crane on the two sides put down the cargo carrier 25 totally and separate the hook 21 from the ring 22, cargo carrier 25 drives back to the aircraft carrier.

Two cargo carriers 25 drive to the loading/unloading port 5 on both sides of the aircraft carrier respectively, on both sides of the aircraft carrier, the marine lifting unit's hook 21 hook the rings 22 on the corresponding position of cargo carrier 25, and move the cargo carriers 25 to the loading/unloading position B. The crane arm 2 in the container loading/unloading port 5 reaches out the loading/unloading port 5 to arrive above cargo carrier 25, the trolley 9 and sling 10 move to the loading/unloading position B, and transport in turn the container 24 filled with supplies or ammunition in the cabin 26 to on the first carrying board 6 at the loading/unloading position A in the loading/unloading port 5, the first carrying board 6 moves the container 24 into the cabin of aircraft carrier which is in front or at the back of the loading/unloading port 5. Or hang the first operator's cab 8 on the trolleys 9 and move near to the cargo carrier 25, the operator in the first operator's cab 8 connects an oil pipe 7 to the movable oil tank 48 or the fixed oil tank 71 to unload oils, crane arm 77 in the oil loading/unloading port 5 reach out the second operator's cab 75 near to the cargo carrier 25, the operator in the second operator's cab 75 connects an oil pipe 7 to the fixed oil tank 71 to unload oils. After unloading the container 24 in the cabin 26, the trolley 9 and sling 10 lift up the empty container 24 in the loading/unloading port 5 to the cabin 26 one by one. After unloading the oils in the cargo carrier 25 and loading the empty containers, retract the crane arm 2 and crane arm 77 to the loading/unloading port 5, after separate the hook 21 from lift rings 22, two cargo carrier 25 steer to the replenishment oiler.

Ship carrying board 67 on both sides of the replenishment oiler's desk transports the empty cargo carrier 25 from fourth position 80, third position 83 to first position 81, second position 84 for easy marine crane hoisting.

The operator in control cab 35 and the driver in cargo carrier 25 communicate and cooperate through wireless communication to finish the operation of lifting a cargo carrier 25 by using marine lifting units and marine cranes. The operation, lifting, transporting, unloading container 24 from cabin 26 to the container loading/unloading port 5, is finished by the communication and cooperation of the operator in container loading/unloading port 5 and the operator in control cab 35 through wired and wireless communication.

The aircraft carrier replenishment system which is equipped with container and oil tank supplies greatly improves the efficiency of a carrier battle group. The aircraft carrier and replenishment oiler with the replenishment system can also keep the lateral replenishment system by using a rope.

DETAILED DESCRIPTION OF THE EMBODIMENTS

Figure 1:
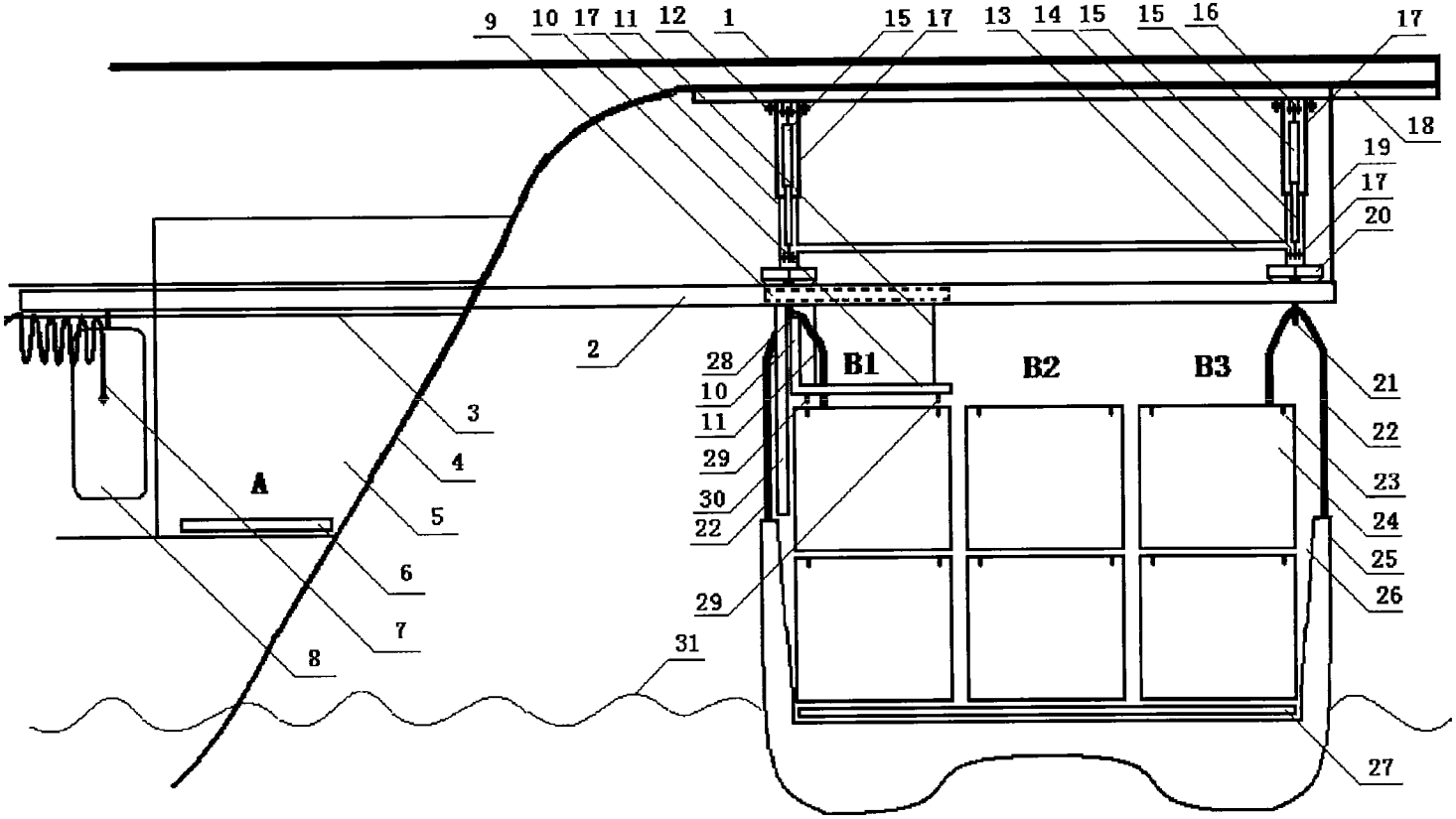
FIG. 1 is the schematic diagram of the relative position of the container loading/unloading port 5 in sidewalls 4 of the aircraft carrier, marine lifting unit, the cargo carrier 25 and container 24 viewing from the front to the back.
Figure 2:
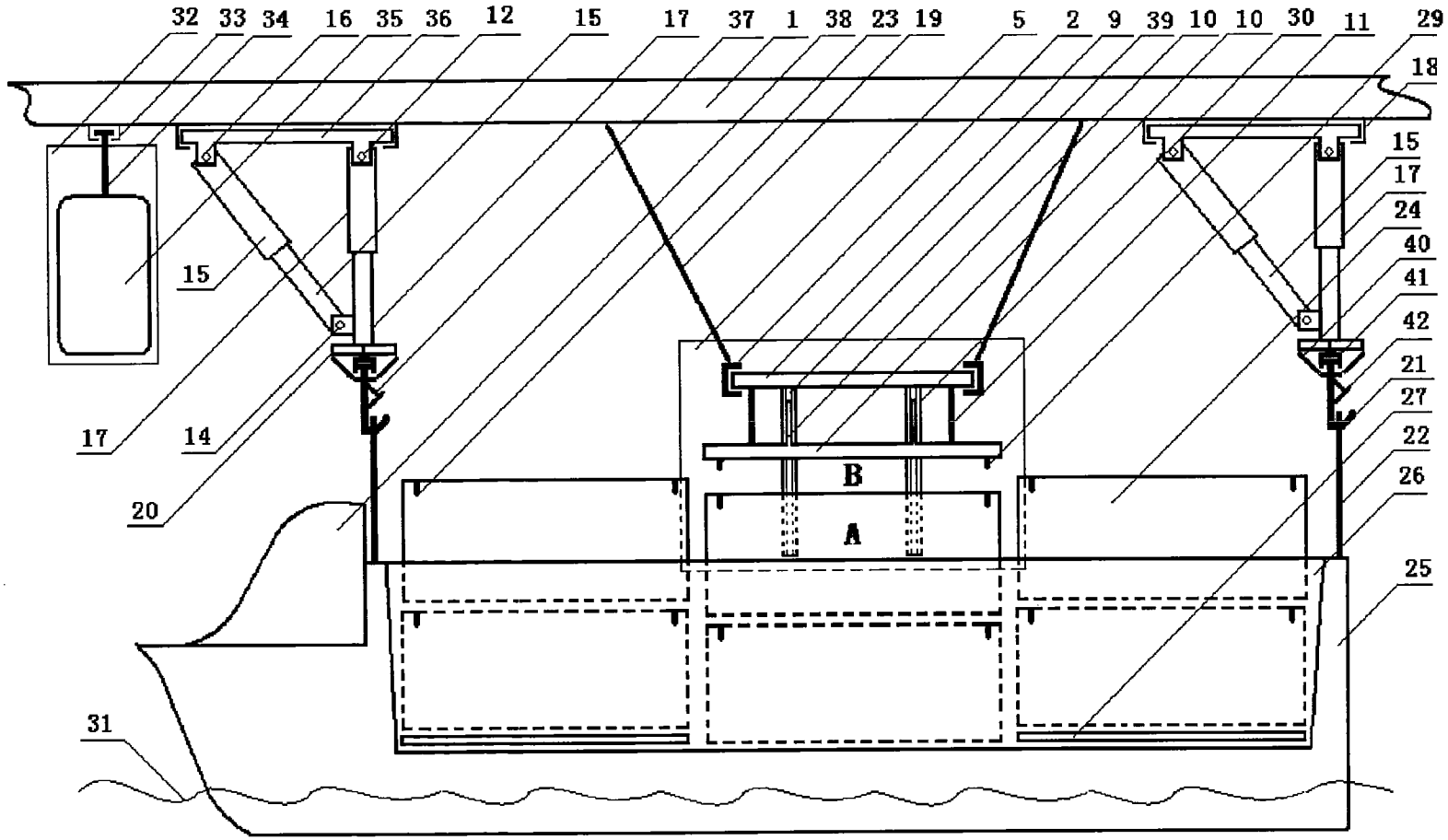
FIG. 2 is the schematic diagram of the relative position of the container loading/unloading port 5 in sidewalls 4 of the aircraft carrier, marine lifting unit, the cargo carrier 25 and container 24 viewing from the left to the right.
Figure 3:
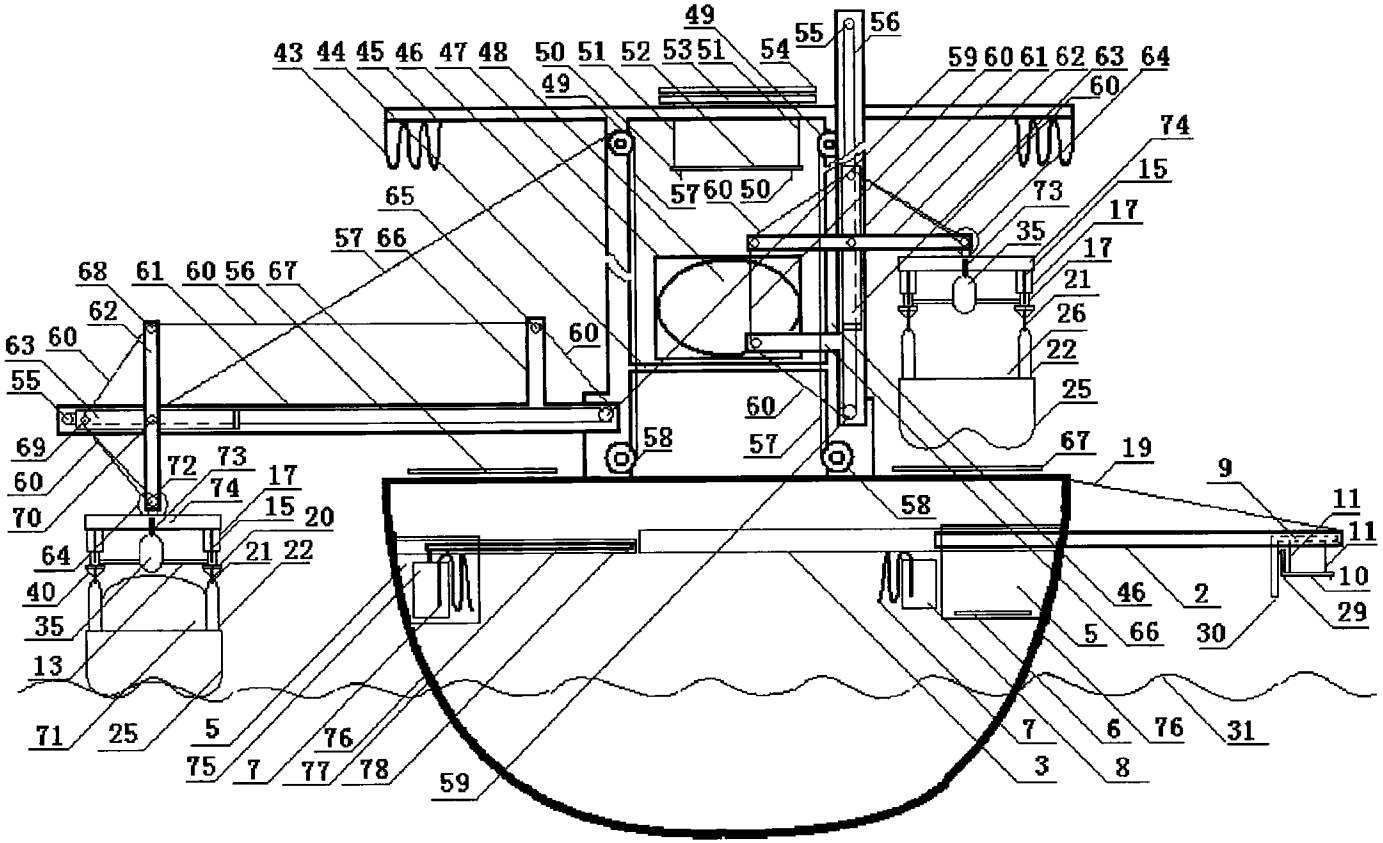
FIG. 3 is the schematic diagram which marine crane hoists the cargo carrier 25 to the deck at one side of the replenishment oiler, and the marine crane hoists the cargo carrier 25 in the sea at other side of the replenishment oiler viewing from the front to the back.
Figure 4:
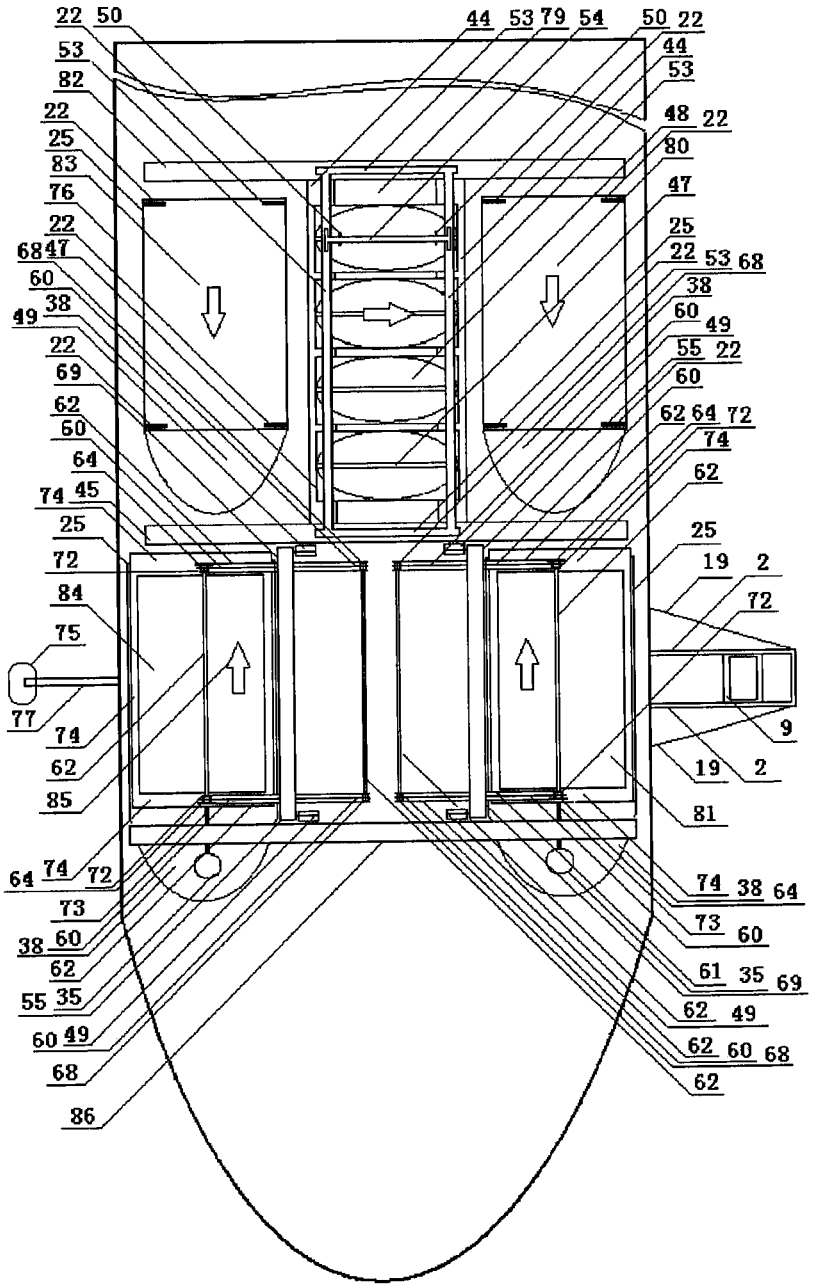
FIG. 4 is the schematic diagram of the replenishment oiler, marine lifting unit, the cargo carrier 25 on the deck viewing from the top to the bottom.

Example 1: as shown in FIG. 1, FIG. 2, FIG. 3, FIG. 4, stipulate the head to tail direction of aircraft carrier and the replenishment oiler as the forward and backward directions, the head of aircraft carrier is the front direction; stipulate the horizontal direction of the forward and backward direction perpendicularity as the left and right direction, face the front and stipulate the direction according to the left and right hands, the end near the hull axial is the inner side, the end away from the hull axial is the lateral side.

The position where sling 10 load and unload containers 24 in the container loading/unloading port 5 on a first carrying board 6 is loading/unloading position A. The position of loading and unloading cargo to which cargo carrier 25 hooked by marine lifting unit and marine crane is moved is loading/unloading position B, the loading/unloading position B in cabin 26 of cargo carrier 25 includes B1, B2, B3 from inside to outside. The terminal of trolley 9 driving in inward direction is loading/unloading position A and the terminal in outward direction is B3. The distance and the relative height between cargo carrier 25 on loading/unloading position B and the loading/unloading port 5 are fixed. The height of loading/unloading position B is based on the stability of cargo carrier 25 on hook 21 which the impact of the buoyancy of the water and waves.

A console located within the container loading/unloading port 5 has the loading/unloading position A, B1, rising, falling, locking, unlocking, inward sliding and outward sliding command key. The console in the control cab 35 on the same side has the loading/unloading position A, B1, B2, B3, rising, falling 1, falling 2, locking and unlocking command key. When press respectively the command key in the loading/unloading position A, B1, B2, B3, the trolleys 9 on the crane arm 2 can automatically walk and accurately arrive at the loading/unloading position A, B1, B2, B3, corresponding to the command key; when press the rising command key, slings 10 would rise or lift the containers 24 to the highest position; when press the falling command key, the slings 10 would fall to the same position of the container 24 on the first carrying board 6; press the falling 1 command key and make sling 10 drop down to the position of containers 24 in the first layer cabin 26; press the falling 2 command key and make the sling 10 drop down to the loading/unloading position of the container 24 in the second layer; press the inward sliding command key and make the first carrying board 6 slide into the loading/unloading port 5, press the outward sliding command key and make the first carrying board 6 slide into the cabin of the replenishment oiler and the aircraft carrier; press the locking and unlocking command and make the spin lock 29 locks and unlocks in the lock hole 23.

A container loading/unloading port 5 and the first operator's cab 8 within the container loading/unloading port 5 is operated by an operator. The operator is responsible for operating the container crane to rising, and falling the container 24 at the loading/unloading position A, and operate the first carrying board 6 to move the container 24 from the loading/unloading position A to the cabin or from the cabin to the loading/unloading position A, take and operate the first operator's cab 8 moving to the cargo carrier 25 and connect the oil pipe 7 to the oil tank 48 and the oil tank 71; there is an operator within every the second operator's cab 75 and the operator is responsible for take and operate the second operator's cab 75 to move to the cargo carrier 25 and to connect the oil pipe 7 to the oil tank 71; there is an operator within every the third operator's cab 35, the operator is responsible for catching the cargo carrier 25 through the marine lifting unit or marine crane, the operator in the third operator's cab 35 of the container loading/unloading port 5 is responsible for the job of operating the container crane to rising and falling the container 24 at the loading/unloading position B, and responsible for the job of the trolleys 9 on the crane 2 moving from the loading/unloading position A to the loading/unloading position B3, the operator in the third operator's cab 35 work rear oriented; there is a driver within every the fourth operator's cab 38, the driver is responsible for the driving of the cargo carrier 25 and operating the second carrying board 27 to move the container 24 from/to the central loading/unloading position B in the cabin 26 to/from the front and back of the cabin 26.

For facilitation of the operators' talking, data transmission, video monitoring and control right transfer, the loading/unloading ports 5, the first operator's cab 8, the second operator's cab 75, the control cab 35 and driving cab 38 are equipped with network communication devices; The position and condition of the operation and process of the trolleys 9 hoisting the container 24 can be seen on the screen in the loading/unloading port 5 and the third operator's cab 35, the control of the trolleys 9 can be exchanged between the loading/unloading port 5 and the third operator's cab 35.

A loading/unloading ports 5 in sidewalls 4 of the aircraft carrier, and in sidewalls 76 of the replenishment oiler, the ports 5 on the left side of the aircraft carrier and the replenishment oiler are the container loading/unloading ports 5, and the ports 5 on the right side of the aircraft carrier and the replenishment oiler are the oil loading/unloading ports 5, The loading/unloading port 5 is on the flange parts of the ship where the waves are small while sailing and the ship deck dangles wide. The first carrying board 6 within the loading/unloading port 5 is higher than the highest waterline of the aircraft carrier+high degree of the flange of the cargo carrier 25 covering above sea level 31. The structure and size of the loading/unloading port 5 in aircraft carrier and the replenishment oiler are same.

There is a left and right setting runway 3 above the container loading/unloading port 5, there is a crane arm 2 in the runway 3, the crane arm 2 is a rectangle frame, the crane arm 2 driving by the power in container loading/unloading port 5 sliding in the runway 3 can be stretched out and in the loading/unloading port 5, the outer end of the crane arm 2 is lifted by two ropes 19, the other end of the two ropes 19 is fixed on the hull by hoist scaling to stretch. There is a trolleys 9 which can move and arrive at the inside/outside the loading/unloading port 5 on the crane arm 2, the below of the four corners of the rectangular trolley 9 are pulled to the sling 10 by four fourth wire ropes 11, fourth wire rope 11 is drove by the windlass on the trolley 9, there are two vertical guide sliders 30 inside the trolley 9, every guide sliders 30 has a runways 39, there are two slide blocks 28 in the up end of slings 10 embedded within two runways 39 respectively, slings 10 can slide up and down on a runways 39, slings 10 slides down at the loading/unloading position A and B relying on its own gravity and makes the spin lock 29 accurately inserted into the lock hole 23 of container under the guide of the guide slider 30. After the spin lock 29 lock the lock hole 23, the sling 10 pulls upward the container 24 by four fourth wire ropes 11. There is a first operator's cab 8 in the container loading/unloading port 5 which hung to the trolley 9 can move on the crane arm 2 and arrive at the outside of the loading/unloading port 5, the first operator's cab 8 is using for carrying the operator to the nearby the cargo carrier 25 to connect the oil pipe 7 to the oil tank 48 and the oil tank 71. There is a crane arm 77 which can extend outward installing in the runway 78 in the oil loading/unloading port 5, there is a second operator's cab 75 hanging outer side the crane arm 77, the second operator's cab 75 is using for carrying the operator to the nearby the cargo carrier 25 to connect the oil pipe 7 to the oil tank 71. There are many oil pipes 7 within the first operator's cab 8 and the second operator's cab 75 using for different fuel loading and unloading, its outer end interface is different specification corresponding to different oil hold tank interface, the inner port connects to different oil tanks within the Cabin.

After four rings 22 in the cargo carrier 25 are hooked by four hooks 21 of the marine lifting unit and four marine crane, the crane arm 2 and the crane arm 77 stretch out from the loading/unloading port 5; after the crane arm 2 and the crane arm 77 holding back from the loading/unloading port 5, the four hooks 21 of the marine lifting unit and the marine crane separate from the four rings 22.

Two first carrying boards 6 in tandem in the loading/unloading port 5 move forward and backward and transport the container 24 from/to the loading/unloading position A to/from the cabin of aircraft carrier and the replenishment oiler.

The third operator's cab 35 in the aircraft carrier is lifted by the crane 34 to slide toward outside and inside on the runway 33 and get into the window 32.

On both sides of the aircraft carrier, there is respectively a marine lifting unit above the outside of the loading/unloading port 5 of the aircraft carrier, beneath the aircraft carrier's deck 1, the marine lifting units are used to hang and secure the cargo carrier 25 in the sea; the dangling ship deck outside the loading/unloading ports 5 is narrow, the slide frame 36 on the right side of the marine lifting units can be telescopic and slide to the outside edge of deck 1.

On each of a gantry's column of a replenishment oiler's first gantry 86 and a second gantry 45, there is respectively a marine crane to hang and secure the cargo carrier 25 in the sea and to lifting the empty cargo carrier 25 from/to the sea to/from a first position 81 or a second position 84 on the replenishment oiler's deck.

Each marine lifting unit in the aircraft carrier or each marine crane in the replenishment oiler has four hydraulic arms, there is a hook 21 in the bottom of every hydraulic arms. The Four hydraulic arms in the marine crane are installed under the four corners of gantry 74. Below the front slide frame 36 of marine lifting unit installs two sets of hydraulic arm, installs two sets of hydraulic arm below the back slide frame 36, the distance between the hooks 21 of two hydraulic arm below the same slide frame 36 is same as between two rings 22 from left to right on the cargo carrier 25, the distance between the hooks 21 of two hydraulic arm in tandem below the slide frame 36 is same as between two rings 22 in tandem on the cargo carrier 25, cargo carrier 25 are hooked and stabilized depend on the four hooks 21 hook the four rings 22 in the four corners of the cargo carrier 25, the slide frame 36 is driven which sliding in the slide 18 in the direction of inside and outside.

Figure 5:
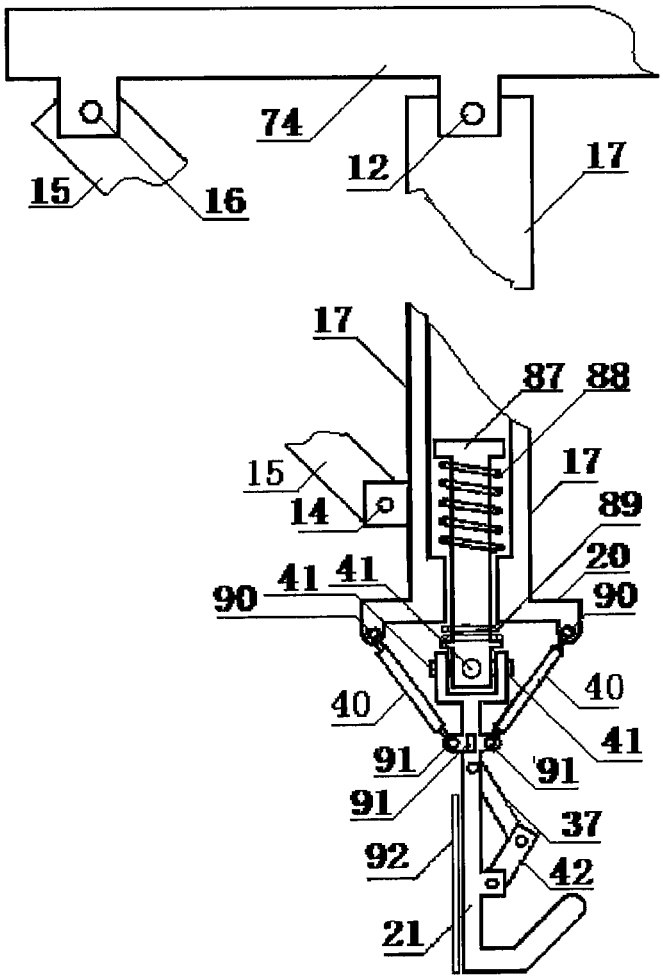
FIG. 5 is the schematic diagram of marine lifting unit and the structure of the hook on the marine crane.

There are two hydraulic cylinder in one set of hydraulic arm, the hydraulic cylinder 17 is in the back, its upper end is connected with the joint axle 12 in the slide frame 36 and gantry 74, its bottom is a square plate 20, as shown in FIG. 5, it connects the hooks 21 by a cardan joint 41 under the square plate 20, the mouth of the hooks 21 is backward; the hydraulic cylinder 15 is in the front, its upper end is connected with the joint axle 16 of the slide frame 36 or the gantry 74, its lower end is connected with the joint axle 14 at the back of the hydraulic cylinder 17; the end of two hydraulic cylinder 17 at the same line is connected and fixed by stick 13. The hydraulic cylinder 15 and hydraulic cylinder 17 working together can make the hooks 21 rise, fall, swing back and forth to hook rings 22 and rise and fall the cargo carrier 25. Hook mouth locking plate 42 is driven by the hydraulic cylinder 37, hook mouth locking plate 42 locking with the hooks 21 can prevent the rings 22 come off. There is respectively a tension springs 40 in the front, back, left and right of the square plate 20, the other end of the four tension springs 40 is connected with the hooks 21, the four tension springs 40 is using for buffering the impact to the hooks 21 in the horizontal and vertical direction while hooking the rings 22. There are pressure springs 88 and pressure springs 89 between the square plate 20 and the cardan joint 41 which is using for buffering the impact to the hooks 21 in the vertical direction while hooking the rings 22. 87 is the shaft lever of pressure springs 88 and pressure springs 89, 90 is tension spring 40's hang hole hanging on the square plate 20, 91 is tension spring 40's hang hole hanging on the hook 21, 92 is display lamp where hook 21 is behind.

When working, the front two hydraulic cylinders' hook 21 of the marine lifting unit or marine crane hook the front two lift rings 22 of cargo carrier 25 and lock them with lock bar 42. Then, the latter two hydraulic cylinders' hook 21 hook the latter two lift rings 22 and lock them with lock bar 42.

In the each of the four gantry's columns of the replenishment oiler's first gantry 86 and second gantry 45, there is a first windlass 58, the two first windlasses 58 on the same side are fixed on the same shaft, driven by the same motor; the gantry frame arm 61 of marine cranes sway around the shaft of a second windlass 59 between the highest and lowest position as a supine position make by the self gravity of the marine cranes on both sides of the replenishment oiler and the first windlass 58's pulling the second wire rope 57.

In one gantry frame arm 61, there have two second windlasses 59 in tandem and are fixed on the same shaft, driven by the same motor; two first wire ropes 56 front and rear round the first pulley 55 and the second windlass 59 several times in the same way and are fixed with one point on the second windlass 59 and then are connected to the slide frame 63's inside and outside ends to become closed loop. The slide frame 63's two front and rear frame bars are in front and rear frame bars' medial grooves of the gantry frame arm 61 and first wire ropes 56 pulls slide frame 63 to slide in front and rear frame bars' medial grooves of the gantry frame arm 61 driven by the second windlass 59.

The line between the fourth pulley 68 and the second pulley 65 and the line between the first pulley 55 and the second windlass 59 are parallel. The shaft 70 connects the two movable frames by the axes of frame 62 and slide frame 63 in front and rear direction. The front and rear two third wire ropes 60 round the second windlass 59 several times in the same way and the end is fixed on the second windlass 59. The another end of the third wire rope 60 rounds second pulley 65, the fourth pulley 68, the fifth pulley 69 starting from the second windlass 59 and round the sixth pulley 72 to return back and round the fifth pulley 69 again, then is fixed on the shaft of the fourth pulley 68, the third wire rope 60 ties two ends of the shaft of the sixth pulley 72 to reduce bending on frame 62 which is produced by the weight of cargo loaded on gantry 74. The fifth pulley 69 is the double pulleys. The shaft from bar 66 near one side of the second pulley 65 to the first windlass 58 can be fixed by third wire rope 60 to prevent the bar 66 from breaking off.

The third wire rope 60 is driven by the second windlass 59 and can stretch in equal length with the first wire rope 56. The second windlass 59 drags the first wire rope 56 when rotating in one direction, driving slide frame 63 and frame 62 slide inward, making the third wire rope 60 and the first wire rope 56 stretch synchronously; the second windlass 59 drags the first wire rope 56 when rotating in adverse direction, the first wire rope 56 slides outward around the first pulley 55 with slide frame 63 and frame 62. Frame 62 pulls the third wire rope 60 and the first wire rope 56 to stretch synchronously. The inside and outside bar of frame 62 are respectively the fourth pulley 68 and the sixth pulley 72's shafts. The outside bar of slide frame 63 is the fifth pulley 69's shaft.

Gantry 74's central axis in front and rear direction is fastened into movable connection by outside aciform frame bar of frame 62. Gantry 74 can swing around the shaft of the sixth pulley 72. There is a brake 64 between gantry 74 and frame 62 to prevent gantry 74 from continuing swinging relative to frame 62, the brake 64 pivots the shaft of the sixth pulley 72, and its braking disc is fixed on gantry 74, and its braking caliper is fixed on frame 62. There is a control cab 35 in the front end of gantry 74.

Cargo carrier 25 can be moved to the loading/unloading position B by two slide frames 36 when four hooks 21 on a marine lifting unit catch four rings 22 on the cargo carrier 25; cargo carrier 25 can also be moved to loading/unloading position B by slide frame 63's sliding and gantry frame arm 61's swinging when four hooks 21 on a marine crane catch four rings 22 on the cargo carrier 25.

When the gantry frame arm 61 is in vertical upward position, the sliding of slide frame 63 has the function of going up and down, when the gantry frame arm 61 is in horizontal level, the sliding of slide frame 63 has the function of sliding inward and outward, when the gantry frame arm 61 is in the position between vertical upward and horizontal level, slide frame 63 slides slant.

There are four cargo carriers 25 shuttling between the aircraft carrier and the replenishment oiler, among which three's cabin 26 are fixed tank 71, the other one's cabin 26 is suitable to carry both three movable oil tanks 48 or 2 layers of containers 24 placed up and down, the containers of each layer are arranged in three rows from left to right and in three lines from front to back. The size of container 24 is standard container 20', the length of an oil tank 48 is a container's length, and the width of an oil tank 48 is about three containers' width, the height is two containers' height. Oil tank 48 can be in mixed shipment with containers 24 and containers 24 must be put in the middle of cargo carriers 25 when mixed shipment.

The second carrying board 27 at the bottom of cargo carriers 25's cabin 26 can move forward and backward controlled by driver in cargo carriers 25 which is made of lightweight and high strength materials.

There is respectively one ship carrying board 67 on both sides of the replenishment oiler's deck, ship carrying boards 67 can transport a cargo carrier 25 from/to first position 81, second position 84 between the first gantry 86 and the second gantry 45, to/from fourth position 80 and third position 83 between second gantry 45 and third gantry 82. There is respectively an empty cargo carrier 25 to fix oil tank 71 on third position 83 and second position 84. There is an empty cargo carrier 25 to fix oil tank 71 on fourth position 80. There is an empty cargo carrier 25 transporting containers 24 on first position 81. If you want to change the position of cargo carriers 25 on fourth position 80 and first position 81, the positions of two cargo carriers 25 can be changed after hanging them in the sea. Movable tank 48 and container 24 can be mixed loaded in cabin 26.

On both sides of the middle part of fixed oil tank 71, there is a connector connecting oil pipe 7. On the front and rear side of right side of movable oil tank 48, there is a connector connecting oil pipe 7.

Above the central position 79 between second gantry 45 and third gantry 82, and between fourth position 80 and third position 83, there is a suspended movable oil tank 48's shelf 44, the shelf 44 is slightly higher than the cargo ship 25's margin placed on deck. Above the shelf 44, there is a crane 53 which can be driven to slide on the left and right on second gantry 45 and third gantry 82. On the crane 53, there is a trolley 54 sliding forward and backward. Under the trolley 54, there is a sling 52. Trolley 54 and sling 52 are connected by two fifth wire ropes 51 rolled synchronously by windlass. Under the sling 52, there are two hooks 50. When it comes to use the cargo carrier 25 for loading containers 24 to ship fuel, empty movable oil tanks 48 on the position 44 can be shipped to cabin 26 of cargo carrier 25 on fourth position 80 by crane 53, or empty movable oil tank 48 in cabin 26 on cargo carrier 25 on fourth position 80 can be shipped on shelf 44. There can be put three or four movable oil tanks 48 on shelf 44. 85 is direction arrow that cargo carrier 25 be moved on the deck.

In order to keep the aircraft carriers and the replenishment oiler in the steady state, the operation of the marine lifting unit and a marine crane for loading and unloading of goods and materials on both sides should try to go on simultaneously.

Abeam replenishing rig on existing replenishment oiler's gantry can be still existed, 43 is an abeam replenishment oil pipe.

When starting replenishing, two sides of the gantry frame arm 61 hang vertically cargo carrier 25 on first position 81 and second position 84. The two operators in control cab 35 of the replenishment oiler respectively operate the second windlass 59 to drag the first wire rope 56 in order to make slide frame 63 slide upward in front and rear frame bars of the gantry frame arm 61, thus rising frame 62, gantry 74 and cargo carrier 25, operate the first windlass 58 to release the traction of the second wire rope 57 for the gantry frame arm 61 leaning gravity gantry 74 and the gravity of cargo carrier 25 swing in infer lateral direction to the horizontal position, then operate the second windlass 59 and the first windlass 58 to move cargo carrier 25 to loading/unloading position B, hook 21 is not separated from the cargo carrier 25's ring 22. After cargo carrier 25 arrives at loading/unloading position B, inform operators in loading/unloading ports 5 of two sides respectively of handling the arm of the crane arm 2 and crane arm 77 out to the loading/unloading ports 5; inform driver in cargo carrier 25 of moving the second carrying board 27 to the middle of cabin 26. Operator in container's loading/unloading ports 5 presses loading/unloading position A command key, inward sliding command key, falling command keys, locking command keys and rising command key to make container 24 suspend on the loading/unloading position A from loading/unloading position A by trolleys 9 and slings 10, then presses outward sliding command key and the first carrying board 6 comes back to the cabin of the replenishment oiler. After the operator in control cab 35 takes over the operational control, presses B3 command key, falling 1 command keys, unlocking command keys, lifting command key and loading/unloading position A command key to put the container 24 on the second carrying board 27's B3 and sling 10 rises. The trolley 9 comes back to loading/unloading position A. After staff in cabin of the replenishment oiler putting another container 24 on the first carrying board 6, operator in loading/unloading port 5 presses inward sliding command key, the first carrying board 6 moves container 24 in cabin of the replenishment oiler to loading/unloading port 5 for the preparation of the second container 24's shipment. The operator in control cab 35 first fills the lower layer, then fills the upper layer of container 24 on the second carrying board 27 according to the sequence of B3, B2, B1. After the second carrying board 27 is full of containers 24, drivers move the second carrying board 27 back to the original position, and move the another second carrying board 27 to the middle of cabin 26, after fill the container 24 according to the same order, move the second carrying board 27 to the original position, finally in the middle bottom of the cabin 26, fill the container 24 according to the same order. When loading and unloading oil, the operators of two loading/unloading ports 5 respectively ride and operate operations cabs 8 and operation cabs 75, moving to near cargo carrier 25 to connect respectively oil delivery pipes 7 in the two loading/unloading ports 5 to oil tank 71 or oil tank 48 on two cargo ships 25 for loading oil. The first operator's cab 8 is hanging on the trolley 9, following trolley 9 for moving near to cargo carrier 25. After the loading, the operators in two loading/unloading ports 5 respectively stretch crane arm 2 and crane arm 77 back to loading/unloading ports 5. The operators in two control cabs 35 operate marine crane to put cargo carrier 25 completely into the sea, unlock lock bar 42, separate the rear two hooks 21 and ring 22, then separate the front two hooks 21 and ring 22. The operator in control cab 35 informs drivers of setting sail, the driver drivers cargo carrier 25 to the aircraft carrier.

The operators in two control cab 35 operates respectively both sides of replenishment oiler marine crane's gantry frame arm 61 erect, the workforce in the replenishment oiler moves the cargo carrier 25 on ship carrying board 67 from fourth position 80 and third position 83 to first position 81 and second position 84. The operators in two control cabs 35 hang cargo carrier 25 in the sea and move to B, then unload the oil.

When cargo carrier 25 drives near the aircraft carrier, operators in two control cabs 35 of the aircraft carrier operate respectively two hydraulic arms on the front of the marine lifting units on the two side to cooperate with the drivers in driving cab 38 to hook two rings 22 on the front of the cargo carrier 25, then to operate respectively two hydraulic arms on the back of the marine lifting units to hook two rings 22 on the back of the cargo carrier 25, Lock ring 22 with a lock bar 42 and move the cargo carrier 25 to the loading/unloading position B. After cargo carrier 25 moves to the loading/unloading position B, operator in control cab 35 informs operators in two loading/unloading ports 5 respectively stick the crane arm 2 and crane arm 77 out of the loading/unloading ports 5; the operator in control cab 35 respectively press B1 command key, falling 2 command keys, locking command keys, rising command key and loading/unloading position A command key to move the trolley 9 and sling 10 to B1 and decline, lock and suspend the second layer of container 24 on the second carrying board 27 and move to the loading/unloading position A. After the operator in loading/unloading ports 5 took over the operational control, press falling command key, unlock command key, lifting command key, outward sliding command key, position B1 command key, the trolley 9 unload container 24 and want back to position B1. After the container 24 are unload completely from the cargo carrier 25 to unload empty container 24 from container loading/unloading ports 5 to cargo carrier 25. The sequence of unloading is the same as the sequence of unloading container 24 from the replenishment oiler to cargo carrier 25.

The order of unloading containers 24 from cabin 26 is: first unload the three containers 24 in the upper layer of second row, the discharge of the order is: B1, B2, B3; and unload container 24 in the below layer of second row in the same order, After the second carrying board 27 moving the container 24 in front and rear rows to the second row of cabin, unload container 24 in the same order.

In order to strengthen the stability of container 24 in cabin 26, we can connect the two layers of container 24 with controllable spin lock, the lowest layer of the container 24 can be connected with the second carrying board 27 and the bottom board of cabin 26 by controllable spin lock.

During the loading of three movable oil tanks 48, they can be connected by communicating pipes, the total joint after connecting associated with the oil pipe 7 is on the movable oil tank 48 in the middle of cabin 26. The highest speed of sailing about cargo carrier 25 is significantly faster than the speed of aircraft carriers and the replenishment oiler, so that we can catch the aircraft carriers and the replenishment oiler which are sailing.

In front of ring 22 is the display light for operation at night. Main propulsion propeller and rudder are in the rear cargo carrier 25. Second rudder and second propeller for adjusting driving direction of cargo carrier's head can be put in the front of the central cargo carrier 25. On both sides of the cargo carrier 25 are bump rubber. Cargo carrier 25 is designed to wave piercing catamaran, so cargo carrier 25 can run more stably.

In order to reduce the height of the marine lifting unit in the aircraft carrier, the fixed frames can be increased between the below of deck 1 of the aircraft carriers and the marine lifting unit.

There is a video camera downward on trolley 9 for observing the loading and unloading of container 24 by control cab 35's operators.

The invention claimed is:

1. An aircraft carrier replenishment system designed to transport cargo using containers and oil tanks, wherein comprising: A. loading/unloading ports in sidewalls of the aircraft carrier and in sidewalls of the replenishment oiler, the ports on one side of the aircraft carrier and the replenishment oiler are the container loading/unloading ports, which are used to load/unload containers and oils, and the ports on the other side of the aircraft carrier and the replenishment oiler are the oil loading/unloading ports which is used to load/unload oils specially; inside the container loading/unloading ports, there is a container crane which can move and arrive at the outside the container port along a runway, and a first operator's cab hung to the container crane to the outside of the loading/unloading port, the container crane comprises a crane arm, a trolley and a sling, the trolley lifts the sling by four fourth wire ropes which are driven by a windlass, the trolley runs on the crane arm, the sling carries the container and transports the container from/to at least one first carrying board on the loading/unloading position inside the loading/unloading port to/from the cargo carrier secured to the loading/unloading position; inside the oil loading/unloading port, there is a second operator's cab hung on an outer side of a crane arm which can move along a runway and arrive at the outside of the oil loading/unloading port, both the first operator's cab and the second operator's cab can approach a side of the cargo carrier and connect an oil pipe to the oil tank or to the oil tank to load/unload oils; inside the container loading/unloading port, a plurality of first carrying boards can slide forward and backward to move the containers from the loading/unloading position in the loading/unloading port to the cabin of the replenishment oiler and the aircraft carrier, or to move the containers from the cabin of the replenishment oiler and the aircraft carrier to the loading/unloading position in the loading/unloading port; B. on each sides of the aircraft carrier, there is respectively a marine lifting unit which is beneath the aircraft carrier's deck above the outside of the loading/unloading port of the aircraft carrier, the marine lifting units are used to hang and secure the cargo carrier in the sea; on the left side and the right side of a gantry's column of a replenishment oiler's first gantry and a second gantry, there is respectively a marine crane to hang and secure the cargo carrier in the sea and to move the empty cargo carrier from/to the sea to/from a first position or a second position on the replenishment oiler's deck; each marine lifting unit or marine crane has four hydraulic arms, and each of the four hydraulic arms has two hydraulic cylinders, cylinder and cylinder, a higher end of the cylinder is connected to the front end of the slide frame and a higher end of the cylinder is connected to the back end of the slide frame, or a higher end of the cylinder is connected to the front end of the gantry and a higher end of the cylinder is connected to the back end of the gantry, and a lower end of the cylinder and a lower end of the cylinder are connected with each other, there is a hook at the lower end of the cylinder, the hydraulic cylinder and the hydraulic cylinder work together to move the hook forward, backward, upward and downward; each said marine lifting unit has two slide frames and two runways, a left and right hydraulic arm beneath each slide frame, wherein the slide frame is driven inward/outward along the runway; each marine crane also comprises a gantry frame arm, a frame, a slide frame, a gantry, a first windlass, a second windlass, a first wire rope, a second wire rope, a third wire rope, a first pulley, a second pulley, a third pulley, a fourth pulley, a fifth pulley and a sixth pulley; wherein one end of the gantry frame arm is fixed to the shaft of the second windlass, the other end is secured to the second wire rope driven by the first windlass and sways between the highest and lowest luffing position; the frame and the slide frame are tied together by a shaft into a cross shape movable connection, the first wire rope winds around the first pulley and the second windlass plural times and connects to one point on the second windlass and then connects to the inner end and the outer end of the slide frame respectively to form a closed cycle which is pulled by the first wire rope and driven by the second windlass, the slide frame driven by the first wire rope can slide in a front bar and a rear frame bar of the gantry frame arm, the third wire rope is driven by the second windlass and can stretch in equal length with the first wire rope, the third wire rope winds around the second pulley, the fourth pulley, the fifth pulley, and the sixth pulley, returns back and winds around the fifth pulley, then are fixed to a shaft of the fourth pulley, the third wire rope ties two ends of the shaft of the sixth pulley so to reduce bending moment on the frame which is produced by the weight of cargo loaded on gantry; a shaft shaped frame bar outside the frame is tied to the upper of the central point of the gantry via a movable connection, each of the four hydraulic arms is provided under each of the four corners of the gantry, the four hydraulic arms form a rectangle; the distances between four hooks at ends of the four hydraulic arms of the marine lifting unit or the marine crane are equal to the distances between four lift rings at four corners of the cabin; wherein the cargo carrier can be moved to the loading/unloading position by two slide frames when four hooks on the marine lifting unit catch four rings on the cargo carrier; the cargo carrier can also be moved to loading/unloading position by moving the slide frame and swinging the gantry frame arm when four hooks on the marine crane catch four rings on the cargo carrier; C. there are four cargo carriers shuttling between the aircraft carrier and the replenishment oiler to transport cargo, three of the four cargo carriers have cabins for fixed tanks which are dedicated to transporting oils; one of the four cargo carriers includes the cabin which is suitable to carry three oil tanks or carry 2 or 3 layers of the containers placed up and down, the containers of each layer are arranged in three rows from left to right and in three lines from front to back; at each corner of the cabin, there is a ring; at the bottom of the cabin, there are two second carrying boards for moving the containers from the loading/unloading position at the central part of the cabin to the front part or the rear part of the cabin; D. there is a control cab in front of the marine lifting unit, and a control cab in front of the gantry on the marine crane; the control cab can be used to lift the cargo carrier using the marine lifting units or the marine cranes; for facilitation of the operators' talking, data transmission, video monitoring and control right transfer, the loading/unloading ports, the first operator's cab, the second operator's cab, the control cab of the aircraft carrier and the replenishment oiler and driving cab are equipped with network communication devices; E. there is respectively one ship carrying board on each of the two sides of the replenishment oiler's deck, the ship carrying boards can transport the cargo carrier between the first position, the second position, and a third position, a fourth position; there is a shelf used to store movable tanks between the second gantry and third gantry, and between the fourth position and the third position, and above the shelf, there is a crane which is movable rightward and leftward between the second gantry and the third gantry, there is a trolley on the crane, which can move forward and backward, the trolley carries two windlasses driven fifth wire ropes which can lift and lower a sling, and the sling has two hooks at the end to carry the rack of the movable tank; the crane is used to move the empty movable tanks from the shelf into the cabin of the cargo carrier at the fourth position or transport the empty movable tanks from the cabin of the cargo carrier at the fourth position to the shelf.

2. The aircraft carrier replenishment system designed to transport cargo using containers and oil tanks according to claim 1, wherein there are two downward guides inside the trolley, and there is a runway on each of the two guides at top of the slings, there are two slide blocks which are embedded in the two runways respectively, the slings run along the runway up and down; when the containers are loading/unloading, the cargo carrier is lifted and moved above the loading/unloading position, and the trolley runs to the loading/unloading position, then the slings guided by the guide to fit a spin lock into a lock hole in the container precisely.

3. The aircraft carrier replenishment system designed to transport cargo using containers and oil tanks according to claim 1, wherein there is a lock bar driven by a hydraulic cylinder at the mouth of the each hook, the lock bar can block the mouth of each hook to prevent loosing ring; the square plate is at a lower end of the underneath hydraulic cylinder, there is a cardan joint under the square plate which connects the hydraulic cylinder and the hook, around the square plate, there are four tension springs which connect the hook at one end, the tension springs are used to absorb horizontal and vertical impacts on the hook during lifting of the ring; there are a first compression spring and a second compression spring between the square plate and the cardan joint to absorb vertical impacts on the hook produced by the ring.

4. The aircraft carrier replenishment system designed to transport cargo using containers and oil tanks according to claim 1, wherein there is a brake between the gantry and the frame to prevent the gantry's continue swinging motions relative to the frame, the brake rotates around the shaft of the sixth pulley, and its braking disc is fixed on the gantry, and its braking caliper is fixed on the frame.

* * * * *